US007066183B2

(12) United States Patent
Parcevaux

(10) Patent No.: US 7,066,183 B2
(45) Date of Patent: Jun. 27, 2006

(54) MACHINE FOR FILLING CIGARETTE TUBES OF DIFFERENT LENGTHS

(75) Inventor: Philippe Parcevaux, Cabestany (FR)

(73) Assignee: Republic Technologies (NA) LLC, Glenview, IL (US)

( * ) Notice: Subject to any disclaimer, the term of this patent is extended or adjusted under 35 U.S.C. 154(b) by 209 days.

(21) Appl. No.: 10/454,737

(22) Filed: Jun. 4, 2003

(65) Prior Publication Data

US 2004/0099276 A1 May 27, 2004

(30) Foreign Application Priority Data

Nov. 25, 2002 (FR) ..... 02 14731

(51) Int. Cl.
*A24C 5/54* (2006.01)

(52) U.S. Cl. ..... 131/70

(58) Field of Classification Search ..... 131/70–72
See application file for complete search history.

(56) References Cited

U.S. PATENT DOCUMENTS

| | | | | |
|---|---|---|---|---|
| 5,398,701 | A | 3/1995 | Neumann | |
| 6,206,006 | B1 * | 3/2001 | Schutze et al. | 131/70 |
| 2004/0200485 | A1 * | 10/2004 | Garbarino | 131/70 |

FOREIGN PATENT DOCUMENTS

| | | |
|---|---|---|
| FR | 902458 | 8/1945 |
| FR | 1381852 | 12/1964 |

* cited by examiner

*Primary Examiner*—Dionne W. Mayes
(74) *Attorney, Agent, or Firm*—Blakely Sokoloff Taylor & Zafman

(57) ABSTRACT

The invention provides a machine for filling cigarette tubes, the machine comprising a spoon (120) receiving a load of tobacco and shaping it into a cylinder, an endpiece (210) on which a cigarette tube is placed, a clamping device (330) suitable for clamping such a tube onto the endpiece, and a slide (200) which carries said endpiece and which is movable in translation along the spoon (120), the machine further comprising an end abutment arrangement (130) for the tobacco, the arrangement being directed in such a manner as to hold the tobacco in the direction of the tube to be filled, the machine being characterized in that said abutment arrangement (130) comprises a contact piece (131) making contact with the tobacco, which contact piece is movable between at least two positions, one position in which said contact piece (131) occupies a portion of the tobacco-receiving zone in the spoon (120), and another position in which it leaves said portion empty, such that the extent of the fill of tobacco introduced into a tube differs depending on the position of said piece (131).

9 Claims, 3 Drawing Sheets

MACHINE FOR FILLING CIGARETTE TUBES OF DIFFERENT LENGTHS

The present invention relates to machines for filling empty cigarette tubes with tobacco.

Figure 1:
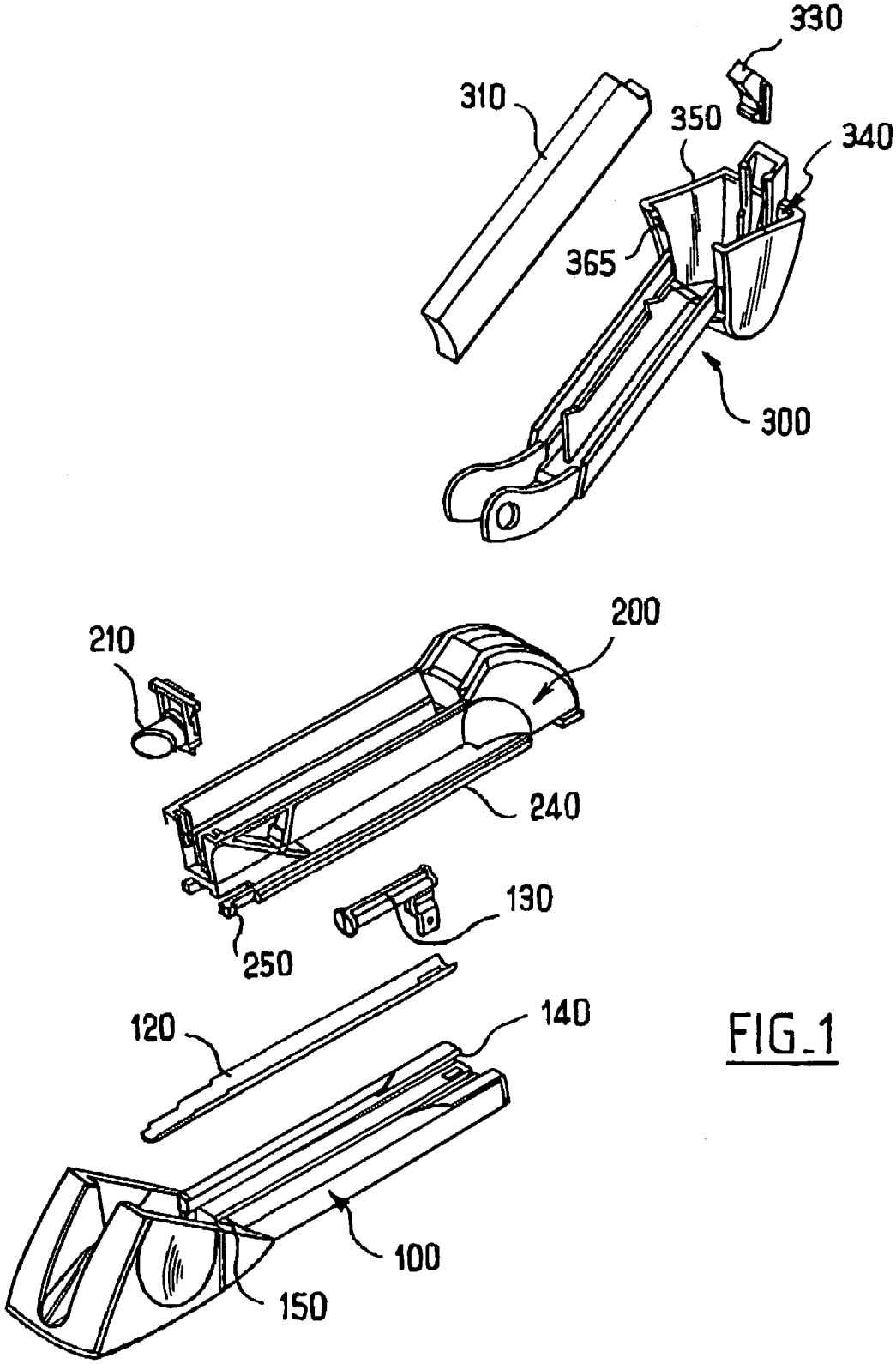
Figure 2:
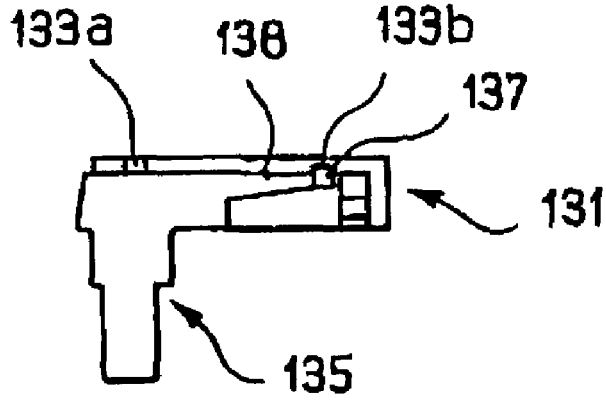
Figure 3:
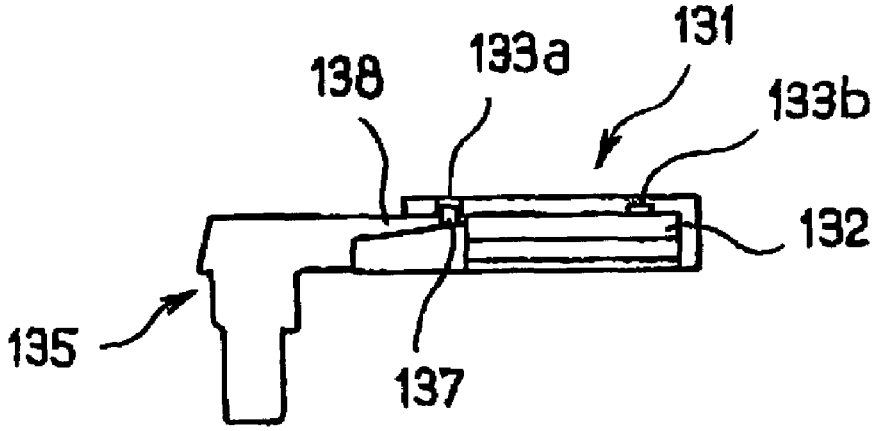

FIG. 1 shows one such machine in order to illustrate the typical facilities of such machines.

Thus, such a machine typically presents a metal plate providing a semi-cylindrical bearing surface referred to as a "spoon" on which a quantity of tobacco is placed by hand, and a hollow endpiece through which the spoon and the tobacco are to pass. The endpiece engages in one end of the tube that is to be filled. The tobacco-filled spoon is thus slid inside the tube through the endpiece, and is then extracted while the tobacco remains in place in the tube.

Some users like sometimes to smoke standard size cigarettes (84 millimeters (mm) size, known as "king" size) and sometimes long cigarettes (100 mm size).

Such users do not find that present tube-stuffing machines are satisfactory since they are designed for tubes having a single predetermined length.

The object of the invention is to propose a tube-stuffing machine capable of filling tubes of different lengths.

For this purpose, the invention provides a machine for filling cigarette tubes, the machine comprising a spoon receiving a fill of tobacco and shaping it into a cylinder, an endpiece on which a cigarette tube is placed, a clamping device suitable for clamping such a tube onto the endpiece, and a slide which carries said endpiece and which is movable in translation along the spoon, the machine further comprising an end abutment arrangement for the tobacco, the arrangement being directed in such a manner as to hold the tobacco in the direction of the tube to be filled, the machine being characterized in that said abutment arrangement comprises a contact piece making contact with the tobacco, which contact piece is movable between at least two positions, one position in which said contact piece occupies a portion of the tobacco-receiving zone in the spoon, and another position in which it leaves said portion empty, such that the extent of the fill of tobacco introduced into a tube differs depending on the position of said piece.

Other characteristics, objects, and advantages of the invention appear on reading the following detailed description made with reference to the accompanying figures, in which:

FIG. 1 is an exploded perspective view of a prior art tube-filling machine; and FIGS. 2 to 7 are detailed views of a tobacco abutment arrangement in accordance with the invention.

The machine for stuffing tubes shown in FIG. 1 comprises three main assemblies constituted by a body 100, a slide 200, and a cap 300.

The body 100 and the slide 200 are designed to slide one on the other when filling a tube. The body mainly comprises a base of large dimensions carrying a spoon 120 (a metal support blade).

The user thus takes hold of the base, which is separated from the spoon 120 by a space, in order to slide the spoon 120 into the tube, which is pulled along the spoon by the slide assembly 200.

The slide 200 is of sufficient longitudinal size to travel all the way along the spoon 120 so as to form a tobacco funnel above it.

At its end corresponding to the free end of the spoon 120, the slide assembly 200 carries an endpiece 210 through which the spoon 120 is to pass. This endpiece 210 forms a cylindrical wall on which the tube to be filled is engaged.

In order to pass the tobacco that is placed on the spoon 120 through the endpiece 210, the cap assembly 300 includes a packer 310 that is placed facing the funnel portion of the slide 200, that is elongate along the spoon 120 and that is of sufficient thickness to press the tobacco in the end of the funnel.

The cap 300 and the slide 200 are pivotally mounted at one of their ends.

The cap 300 presents a pad 330 at its free end which rests against the outside face of the cylinder formed by the endpiece 210. Thus, an empty tube is pinched between the cylindrical wall of the endpiece 210 and the pad 330 when the cap 300 is in the closed position.

It should be observed that the body 100 and the slide 200 present complementary rails 140 and 240 together with releasable clip means 150 and 250 at one of their ends, such that sliding is guided without transverse play and such that the slide 200 is temporarily held in position covering the spoon 120 by the clip means.

Once the fill of tobacco has been put on the spoon 120 and the cap 300 has been closed, the last step of use is particularly simple since it consists in performing a sliding go-and-return operation between the body 100 and the cap 300.

This go-and-return operation gives rise internally to the spoon 120 sliding along the tube that is to be stuffed.

In order to ensure that the spoon 120 does indeed take the tobacco into the tube, the spoon is provided at its end with an arrangement 130 forming an abutment for the tobacco.

This arrangement is shown in FIG. 1 as being a single piece that is mainly cylindrical in shape extending over an end portion of the spoon.

The cylindrical shape makes it possible, at the end of a stroke, for this abutment arrangement 130 to penetrate a short way into the tube for stuffing. This abutment arrangement thus forms a kind of piston for introducing tobacco into the tube.

In addition to that known function, the abutment arrangement of FIG. 1 also constitutes means for fixing the spoon 120 in the machine.

In addition to its cylindrical portion, the arrangement 130 extends laterally in the form of a thin-shaped extension which passes through the spoon 120 and is introduced securely in the body 100 of the machine.

In FIG. 1, the abutment arrangement is thus also an arrangement for holding the spoon 120, with this being necessary both when filling the spoon from above and while sliding for stuffing purposes.

In order to enable tubes of different lengths to be stuffed, it is proposed herein to modify known abutment arrangements. In the preferred embodiment described below, a modification is proposed to the abutment arrangement described above with reference to the FIG. 1 machine.

Naturally, the abutment arrangement described below is also adapted to any other machine for stuffing cigarette tubes.

As shown in FIGS. 2 to 7, the abutment arrangement proposed herein comprises two distinct pieces, one of which is movable relative to the spoon.

More precisely, a piece 131 that comes into contact with the tobacco is mounted with a single,degree of freedom in displacement on a second piece 135, which is itself secured both to the spoon 120 and to the body 100 of the machine.

Movably mounted in this way on the spoon, the contact piece 131 can be put in a position where it occupies a portion of the top cavity of the spoon 120, thus reducing the volume available for filling with tobacco.

In this first position, the user makes a small-fill cigarette, in this case a cigarette of standard length (84 mm).

The second position of the contact piece 131 corresponds to the contact piece being retracted so as to leave a larger volume available for tobacco, and in this case specifically a long length corresponding to a so-called "long" cigarette (100 mm).

To do this, the moving connection of the contact piece 131 is, in this case, a sliding link on the fixed piece 135 making use of a set of rails 136 and of complementary grooves 132 on these two pieces.

It should be observed that in this preferred embodiment, the moving piece 131 remains the piece which comes into contact with the tobacco in both positions. To do this, it has an end surface in the form of a wall extending across the inside volume of the spoon, which wall holds the moving piece at this end.

The moving piece 131 is generally hollow, forming an internal space in which the holding piece 135 can slide.

The sliding rails are formed on the holding piece 135 on either side thereof, and they slide in internal grooves of the contact piece 131.

In order to hold the contact piece 131 firmly in the selected position, provision is provided herein for mutual snap-fastening means between these two pieces 131 and 135.

These snap-fastening means which operate in both of the positions of the contact piece are in the form of a stud 137 mounted on a resilient detent, integrally molded with the holding piece 135, and suitable for coupling with two corresponding orifices 133*a* and 133*b* in the contact piece 131.

The stud 137 is thus provided at the end of a flexible finger 138 extending longitudinally relative to the machine.

The finger 138 bears resiliently against the top inside wall of the contact piece 131, sliding against it while changing position and being received in one of the orifices 133*a*, 133*b* in said wall when the desired position is reached.

More specifically, these two orifices 133*a* and 133*b* are of different shapes, the orifice 133*b* holding the stud 137 in less secure manner than the other orifice. It is desirable in this case for the orifice 133*b* that is less secure to allow the stud 137 to be extracted merely by applying a manual force to cause the contact piece 131 to slide.

In contrast, it is desirable for the second orifice 133*b* to provide firm retention of the stud 137 against mere longitudinal traction being applied to the contact piece 131. Thus, when the stud 137 is in position in the orifice 133*a*, it can be extracted only if the user acts directly on the stud 137 itself.

The secure retention position corresponds to making cigarettes of standard length, while the flexible retention position corresponds to making long cigarettes which is more of an option.

Thus, the deeper orifice 133*a* corresponding to retention in the "standard" cigarette position is constituted specifically by a passage passing through the entire thickness of the top wall of the contact piece 131.

This passage is thus open on top of the device and is accessible to the user from above the contact piece 131.

The user then merely needs to insert a pointed object, such as a pen, into the through orifice 133*a* in order to push back the stud 137 into the contact piece 131 and thus release it from its extended position.

In its preferred variant, the tube-stuffing machine is provided with means for co-operating with the stud 137 for the purpose of releasing it, thereby avoiding the need for such an additional pointed object. In this variant, the tube-stuffing machine is provided with a punch placed on the inside face of the cap 300 and which becomes inserted in the orifice 133*a* receiving the stud in response to external pressure being applied to the rear end of the cap 300.

Figure 4:
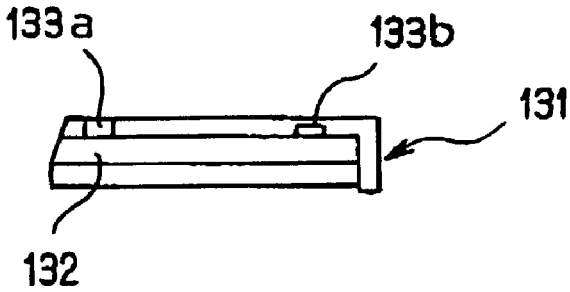
Figure 5:
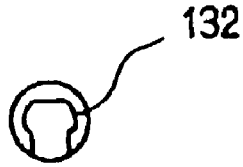
Figure 6:
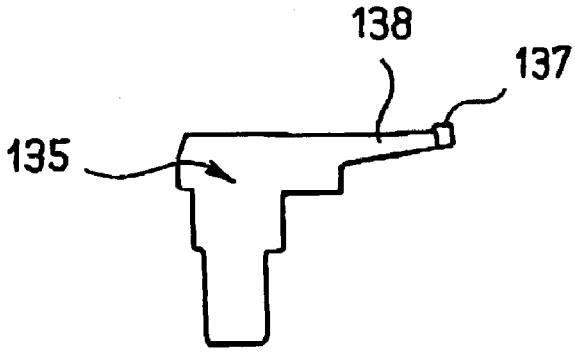
Figure 7:
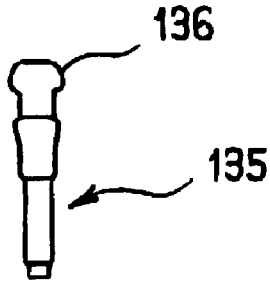

As shown in FIG. 4, the contact piece 131 forms two side flanks which extend over the holding piece 135, these side flanks extending further than the top wall of the piece 131 so as to extend co-operation by means of the rails, even when the contact piece is in its extended position.

The holding piece 135 has side flanks that also extend further forward than said piece, in this case substantially to the same extent as the flexible finger 138 carrying the snap-fastening stud 137.

It should be observed that these holding and contact pieces 135 and 131 can be made of plastics material or of metal.

The invention claimed is:

1. A machine for filling cigarette tubes, the machine comprising a body (100), a spoon (120) receiving a load of tobacco and shaping it into a cylinder, an endpiece (210) on which a cigarette tube is placed, a clamping device (330) suitable for clamping such a tube onto the endpiece, and a slide (200) which carries said endpiece and which is movable in translation along the spoon (120), the machine further comprising an end abutment arrangement (130) for the tobacco, the arrangement being directed in such a manner as to hold the tobacco in the direction of the tube to be filled, said abutment arrangement (130) comprising a contact piece (131) making contact with the tobacco, which contact piece is movable between at least two positions, one position in which said contact piece (131) occupies a portion of the tobacco-receiving zone in the spoon (120), and another position in which it leaves said portion empty, such that the extent of the fill of tobacco introduced into a tube differs depending on the position of said piece (131), wherein the abutment arrangement (130) includes two pieces (131, 135), one of which pieces (135) is mounted stationary relative to the spoon (120) and body (100), and the other of which pieces (131), forming said contact piece, is movably mounted on said stationary piece (135).

2. A machine according to claim 1, characterized in that the stationary piece (135) also has the function of holding the spoon (120) in the machine.

3. A machine according to claim 1 or claim 2, characterized in that the contact piece (131) is slidably mounted on the stationary piece (135).

4. A machine according to claim 3, characterized in that the contact piece (131) and the stationary piece (135) are provided with mutual snap-fastening means (137, 133*a*, 133*b*) for holding the contact piece (131) in at least one of its positions.

5. A machine according to claim 4, characterized in that the snap-fastening means (137, 133*a*, 133*b*) are designed to hold the contact piece (131) in two different positions.

6. A machine according to claim 5, characterized in that the snap-fastening means (137, 133*a*, 133*b*) are provided to provide snap-fastening in one of the two positions that is sufficiently weak to be overcome merely by applying manual force to the contact piece (131) urging it towards the other of the two positions.

7. A machine according to claim 4 wherein the snap-fastening means comprise a stud (137) carried by an elastically deformable member (138), and an orifice (133*a*) passing through a wall and receiving said stud (137) in one of the positions of the contact piece (131).

8. A machine according to claim 7, characterized in that the orifice (133*a*) and the stud (137) are designed to stay together against force being applied simply to the contact piece, and to be separated solely by acting directly on the stud (137).

9. A machine according to claim 7, characterized in that it includes a pivoting cap (300) designed to be folded down onto the spoon (120), and in that the cap (300) is provided on its face facing towards the spoon (120) with a punch for penetrating into the orifice (133*a*) and pushing back the stud (137) through the orifice in reaction to a corresponding force of the user on the cap (300).

* * * * *